US008651602B2

(12) United States Patent
Yabuki

(10) Patent No.: US 8,651,602 B2
(45) Date of Patent: Feb. 18, 2014

(54) LIQUID EJECTION APPARATUS AND METHOD FOR SUPPLYING LIQUID

(71) Applicant: Brother Kogyo Kabushiki Kaisha, Nagoya (JP)

(72) Inventor: Tomoyasu Yabuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/629,470

(22) Filed: Sep. 27, 2012

(65) Prior Publication Data

US 2013/0083100 A1 Apr. 4, 2013

(30) Foreign Application Priority Data

Sep. 30, 2011 (JP) ..... 2011-218724

(51) Int. Cl.
*B41J 2/175* (2006.01)
*B41J 2/00* (2006.01)

(52) U.S. Cl.
USPC ..... 347/7; 347/108; 347/84

(58) Field of Classification Search
USPC ..... 347/5, 6, 7, 19, 108, 85, 86, 84
See application file for complete search history.

(56) References Cited

U.S. PATENT DOCUMENTS

2001/0017641 A1 8/2001 Kobayashi et al.
2004/0174417 A1 9/2004 Kobayashi et al.
2004/0196339 A1 10/2004 Kobayashi et al.
2011/0242180 A1* 10/2011 Yamamoto ..... 347/16
2013/0027490 A1* 1/2013 Sugimoto et al. ..... 347/104
2013/0106965 A1* 5/2013 Yamamoto ..... 347/86
2013/0106967 A1* 5/2013 Yamamoto ..... 347/104
2013/0106969 A1* 5/2013 Yamamoto ..... 347/108

FOREIGN PATENT DOCUMENTS

JP 2001-212971 A 8/2001
JP 2005-081546 A 3/2005
JP 2005-088209 A 4/2005

OTHER PUBLICATIONS

Computer-generated translation of JP 2005-081546, published on Mar. 2005.*
Computer-generated translation of JP 2005-088209, published on Apr. 2005.*

* cited by examiner

*Primary Examiner* — Huan Tran
(74) *Attorney, Agent, or Firm* — Baker Botts L.L.P.

(57) ABSTRACT

A liquid ejection apparatus, including: a head; a main tank storing liquid; a sub-tank for temporarily storing the liquid stored in the main tank, before the liquid is supplied to the head; a liquid amount detector for detecting a liquid amount in the sub-tank; a supplier for supplying the liquid from the main tank to the sub-tank; a first housing; a second housing holding the sub-tank, pivotable with respect to the first housing, and positioned at a close position at which the head is close to the first housing or a distant position at which the head is far from the first housing; and a controller for, when the second housing is located at the close position, controlling the liquid supply based on the detected liquid amount.

12 Claims, 6 Drawing Sheets

LIQUID EJECTION APPARATUS AND METHOD FOR SUPPLYING LIQUID

CROSS REFERENCE TO RELATED APPLICATION

The present application claims priority from Japanese Patent Application No. 2011-218724, which was filed on Sep. 30, 2011, the disclosure of which is herein incorporated by reference in its entirety.

BACKGROUND OF THE INVENTION

1. Field of the Invention

The present invention relates to a liquid ejection apparatus including a liquid ejection head configured to eject liquid from at least one ejection opening and to a method for supplying liquid to a sub-tank of the liquid ejection apparatus.

2. Description of the Related Art

There is known an ink-jet printer including an upper housing and a lower housing, and the upper housing accommodates: a recording head configured to eject ink onto a sheet to record an image on the sheet; and a sub-tank for storing the ink to be supplied to the recording head, while the lower housing accommodates a conveyor mechanism for conveying the sheet. For easier maintenance, this upper housing is pivotable with respect to the lower housing about a rear-side shaft such that a front face of the printer is divided into upper and lower faces.

SUMMARY OF THE INVENTION

The inventor of the present application has conceived a configuration in which a sensor for sensing a liquid level is provided for the above-described ink-jet printer to detect an amount of the ink in the sub-tank, and a control for supplying the ink to the sub-tank is executed based on a result of the detection. However, the inventor has noticed that, as the upper housing is pivoted, a liquid surface of the ink stored in, the sub-tank is inclined with respect to the sub-tank, which may cause an erroneous sensing of the sensor. If the ink is supplied based on the erroneous sensing of the liquid level, the ink may not be supplied sufficiently or may be supplied excessively.

This invention has been developed to provide a liquid ejection apparatus and a liquid supply method in which liquid is not supplied to a sub-tank for storing the liquid to be supplied to a recording head, even if a liquid level in the sub-tank is sensed erroneously because the sub-tank is inclined.

The present invention provides a liquid ejection apparatus, comprising: a platen configured to support a recording medium; a recording head having at least one ejection opening through which liquid is ejected, the recording head being configured to eject the liquid through the at least one ejection opening to record an image on the recording medium supported by the platen; a main tank configured to store the liquid; a sub-tank configured to temporarily store the liquid stored in the main tank, before the liquid is supplied to the recording head; a liquid amount detector configured to detect an amount of the liquid in the sub-tank; a supplier configured to supply the liquid stored in the main tank, to the sub-tank; a first housing configured to hold at least the platen; a second housing configured to hold at least the sub-tank and the recording head and connected to the first housing such that the second housing is pivotable with respect to the first housing so as to be selectively positioned at one of (i) a close position at which the recording head is close to the first housing and (ii) a distant position at which the recording head is farther from the first housing than the recording head located at the close position; a housing position detector configured to detect whether the second housing is located at the close position or the distant position; and a controller configured to: when the housing position detector detects that the second housing is located at the close position, control the supplier to supply the liquid to the sub-tank based on the amount of the liquid which has been detected by the liquid amount detector.

The present invention provides a liquid ejection apparatus, comprising: a platen configured to support a recording medium; a recording head having at least one ejection opening through which liquid is ejected, the recording head being configured to eject the liquid through the at least one ejection opening to record an image on the recording medium supported by the platen; a main tank configured to store the liquid; a sub-tank configured to temporarily store the liquid stored in the main tank, before the liquid is supplied to the recording head; a supplier configured to supply the liquid stored in the main tank, to the sub-tank; a first housing configured to hold at least the platen; a second housing configured to hold at least the sub-tank and the recording head and connected to the first housing such that the second housing is pivotable with respect to the first housing so as to be selectively positioned at one of (i) a close position at which the recording head is close to the first housing and (ii) a distant position at which the recording head is farther from the first housing than the recording head located at the close position; and a controller configured to: when it is detected that the second housing is located at the close position, allow the supplier to supply the liquid to the sub-tank; and when it is detected that the second housing is located at the distant position, inhibit the supplier from supplying the liquid to the sub-tank.

The present invention provides a method for supplying liquid to a sub-tank of a liquid ejection apparatus, the liquid ejection apparatus comprising: a platen configured to support a recording medium; a recording head having at least one ejection opening through which liquid is ejected, the recording head being configured to eject the liquid through the at least one ejection opening to record an image on the recording medium supported by the platen; a main tank configured to store the liquid; a sub-tank configured to temporarily store the liquid stored in the main tank, before the liquid is supplied to the recording head; a liquid amount detector configured to detect an amount of the liquid in the sub-tank; a supplier configured to supply the liquid stored in the main tank, to the sub-tank; a first housing configured to hold at least the platen; a second housing configured to hold at least the sub-tank and the recording head and connected to the first housing such that the second housing is pivotable with respect to the first housing so as to be selectively positioned at one of (i) a close position at which the recording head is close to the first housing and (ii) a distant position at which the recording head is farther from the first housing than the recording head located at the close position; and a housing position detector configured to detect whether the second housing is located at the close position or the distant position, the method comprising, when the housing position detector detects that the second housing is located at the close position, controlling the supplier to supply the liquid to the sub-tank based on the amount of the liquid which has been detected by the liquid amount detector.

The present invention provides a liquid ejection apparatus, comprising: a support portion configured to support a recording medium; a recording head having at least one ejection opening through which liquid is ejected, the recording head being configured to eject the liquid through the at least one ejection opening to record an image on the recording medium supported by the support portion; a main tank configured to store the liquid; a sub-tank configured to temporarily store the liquid stored in the main tank, before the liquid is supplied to the recording head; a liquid amount detector configured to detect an amount of the liquid in the sub-tank; a supplier configured to supply the liquid stored in the main tank, to the sub-tank; a first housing configured to hold at least the support portion; a second housing configured to hold at least the sub-tank and the recording head and connected to the first housing such that the second housing is pivotable with respect to the first housing so as to be selectively positioned at one of (i) a close position at which the recording head is close to the first housing and (ii) a distant position at which the recording head is farther from the first housing than the recording head located at the close position; a housing position detector configured to detect whether the second housing is located at the close position or the distant position; and a controller configured to, when the housing position detector detects that the second housing is located at the close position, control the supplier to supply the liquid to the sub-tank based on the amount of the liquid which has been detected by the liquid amount detector.

In the liquid ejection apparatus and the method described above, the supplier does not supply the liquid when the second housing is located at the distant position. Thus, it is possible to avoid an unintended liquid supply control that is caused by an erroneous sensing of a liquid level in the sub-tank when the sub-tank is inclined.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Hereinafter, there will be described one embodiment of the present invention by reference to the drawings.

Figure 1:
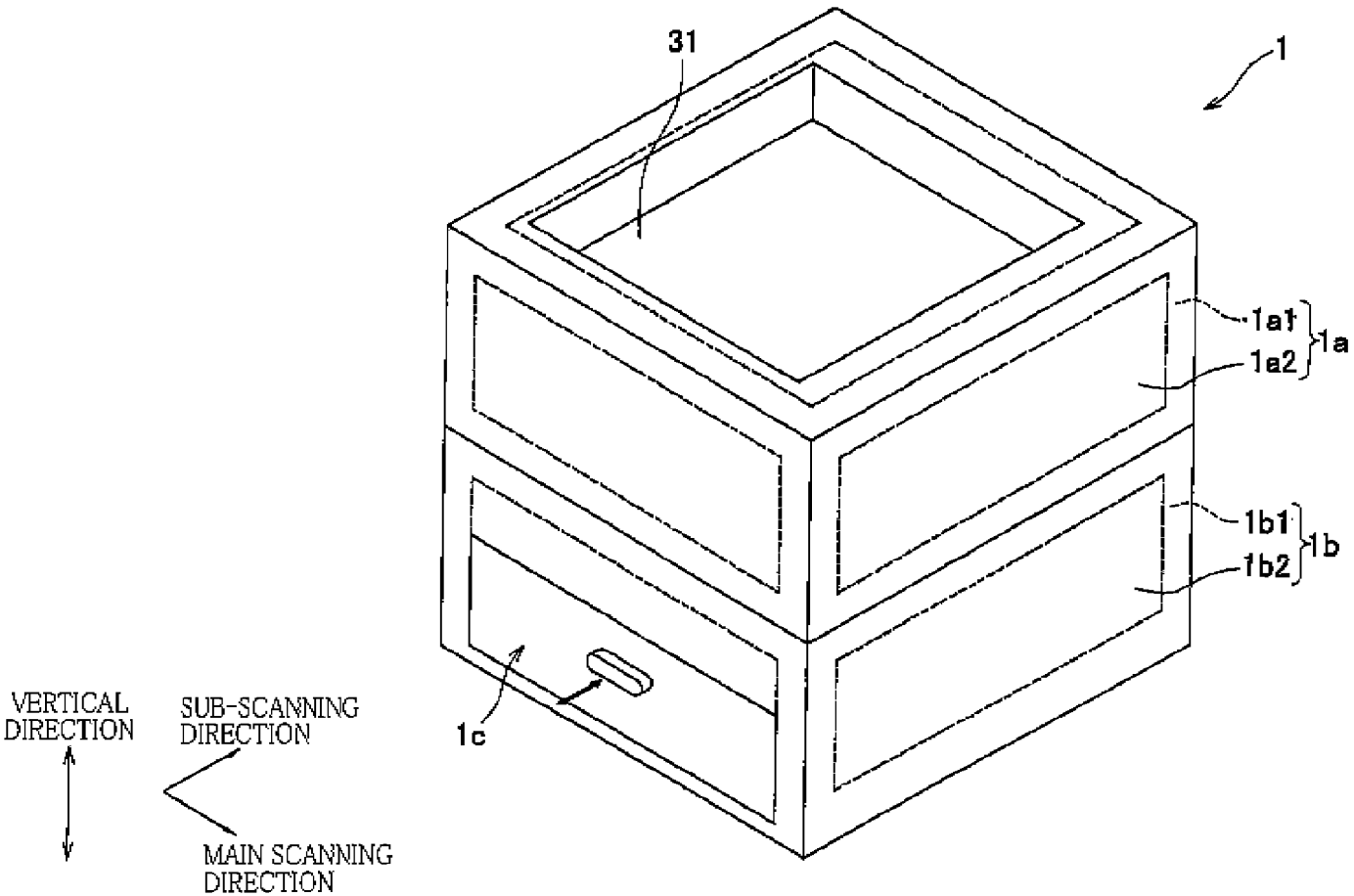
FIG. 1 is an external perspective view showing an ink-jet printer as one embodiment of the present invention.

First, there will be explained an overall construction of an ink-jet printer 1 as one embodiment of a recording apparatus to which the present invention is applied, with reference to FIGS. 1-3.

The printer 1 includes an upper housing (as one example of a second housing) 1*a* and a lower housing (as one example of a first housing) 1*b* each having a rectangular parallelepiped shape and having generally the same size as each other in plan view when seen in a vertical direction. The upper housing 1*a* includes a skeletal frame 1*a*1 and a decorative cover 1*a*2 covering the frame 1*a*1 from an outside thereof. Likewise, the lower housing 1*b* includes a skeletal frame 1*b*1 and a decorative cover 1*b*2 covering the frame 1*b*1 from an outside thereof. When the upper housing 1*a* is superposed on the lower housing 1*b*, a space is defined in the printer 1 (see FIG. 2). A sheet-discharge portion 31 is provided on a top plate of the upper housing 1*a*. In the space defined by the upper and lower housings 1*a*, 1*b*, there is formed a sheet conveyance path through which the sheet P is conveyed from a sheet-supply unit 1*c* which will be described below toward the sheet-discharge portion 31 along bold arrows indicated in FIG. 2.

Figure 2:
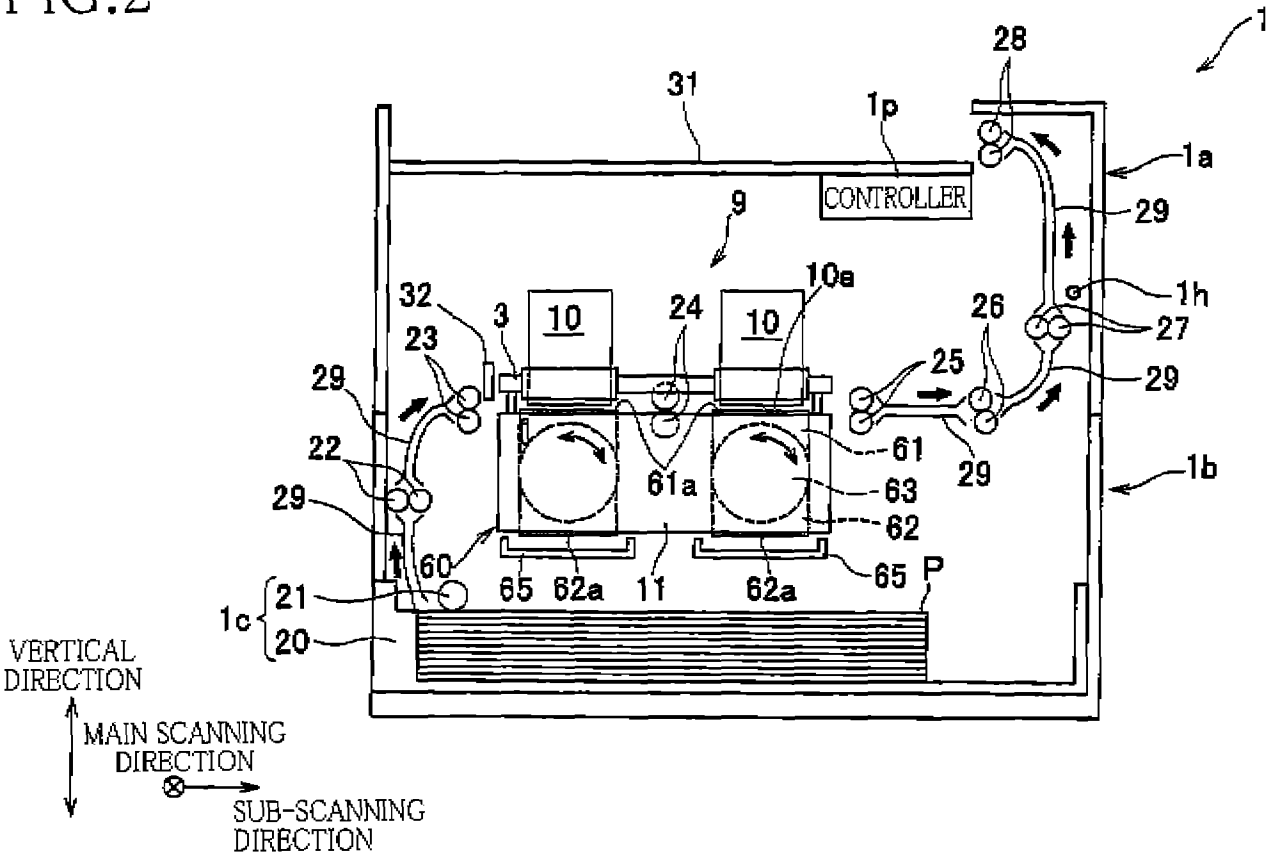
FIG. 2 is a side view generally showing an inside of the printer shown in FIG. 1.
Figure 3:
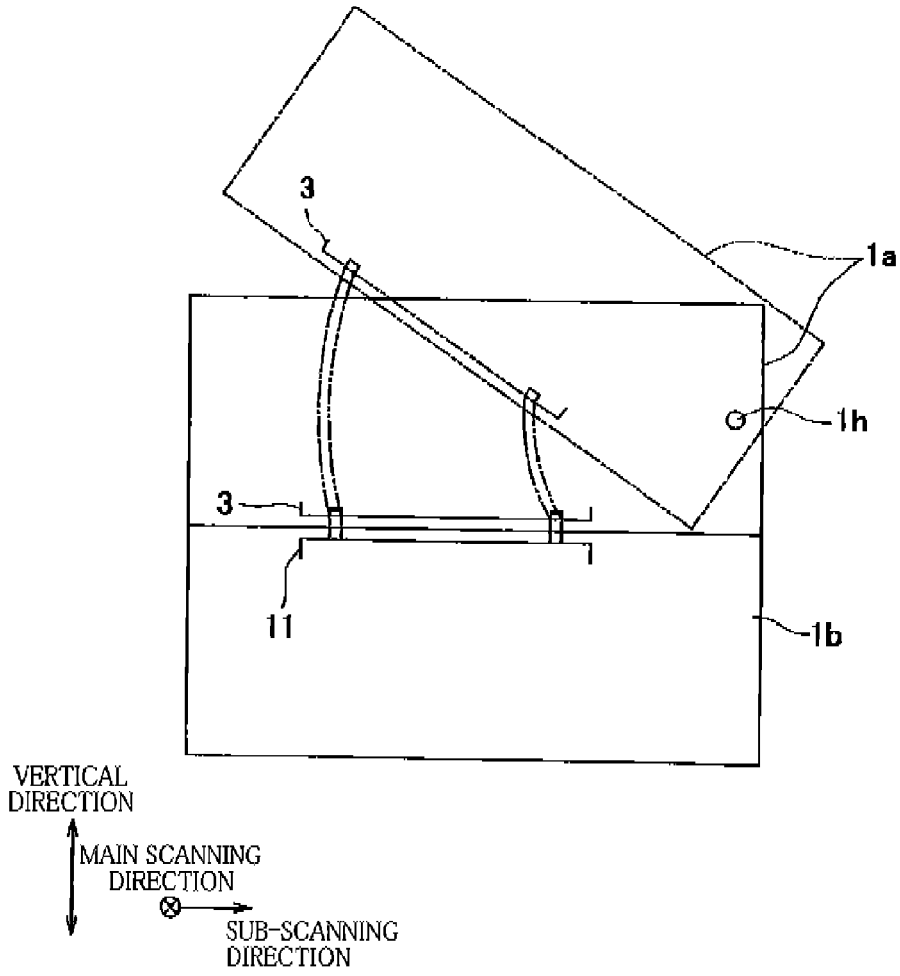
FIG. 3 is a view for explaining a situation in which an upper housing shown in FIG. 2 is pivoted.

As shown in FIGS. 2 and 3, the upper housing 1*a* is connected to the lower housing 1*b* by a shaft 1*h* extending in a main scanning direction at a vertical center of one end portion of the upper housing 1*a* in a sub-scanning direction (i.e., a right end portion in FIGS. 2 and 3). The upper housing 1*a* is pivotable with respect to the lower housing 1*b* about the shaft 1*h*. This pivotal movement can positions the upper housing 1*a* selectively at one of (i) a close (or contact) position that is close to the lower housing 1*b* (as one example of a first position, shown in FIG. 2 and indicated by solid lines in FIG. 3) and (ii) a distant position farther from the lower housing 1*b* than the close position (as one example of a second position, indicated by two-dot chain lines in FIG. 3). When the upper housing 1*a* is located at the distant position, the sheet conveyance path defined by the lower housing 1*b* and the upper housing 1*a* located at the close position is partially exposed, so as to form a work space on an upper side of the sheet conveyance path for a user. When the work space has been formed with the upper housing 1*a* being located at the distant position, the user can clear a jammed sheet or sheets from the sheet conveyance path and can perform a maintenance operation in the sheet conveyance path for maintaining a recording portion 9 and a support portion 60. The maintenance operation for maintaining the recording portion 9 and the support portion 60 is an operation for removing stains from ejection faces 10*a*, support faces 61*a*, facing faces 62*a*, for example. Springs, not shown, are provided on the shaft 1*h* for urging the upper housing 1*a* in a direction in which the upper housing 1*a* is opened (i.e., in a direction from the close position toward the distant position). In the present embodiment, the upper housing 1*a* can be opened up to about 35 degrees with respect to a horizontal plane. It is noted that a left side face of the printer 1 in FIG. 3 is a front face of the printer 1, and a right side face of the printer 1 in FIG. 3 is a rear face of the printer 1.

The upper housing 1*a* accommodates: the two heads 10 (namely, a precoat head 10 configured to eject pretreatment liquid and an ink-jet head 10 configured to eject black ink, in order from an upstream side in a sheet conveying direction indicated by the bold arrows in FIG. 2); a frame 3 supporting the two heads 10 and an upper roller of a conveyor roller pair 24; a head raising and lowering mechanism, not shown, configured to move the frame 3 in the vertical direction; liquid supply mechanisms (see FIG. 4), which will be explained below, for supplying the liquid to the heads 10; and a controller 1*p* configured to control operations of the components of the printer 1. In the present embodiment, the two heads 10 and the frame 3 constitute the recording portion 9 for recording texts and/or an image on the sheet P. The recording portion 9 and the liquid supply mechanisms are supported and held by the upper housing 1*a*.

The upper housing 1*a* further accommodates: upper rollers of conveyor roller pairs 25, 26; upper guides of guides 29 between these roller pairs 25, 26; conveyor roller pairs 27, 28; and two pairs of the guides 29 between the conveyor roller pairs 26, 28 in the sheet conveying direction. That is, when the upper housing 1*a* is pivoted from the close position to the distant position, all the components accommodated in the upper housing 1*a* are moved together with the upper housing 1*a*.

The lower housing 1*b* accommodates the support portion 60, a wiper unit, two waste-ink trays 65, and the sheet-supply unit 1*c*. The lower housing 1*b* further accommodates a sheet sensor 32, conveyor roller pairs 22, 23, and two pairs of the guides 29 between the sheet-supply unit 1*c* and the conveyor roller pair 23 in the sheet conveying direction.

Each head 10 is a line head elongated in the main scanning direction and has a generally rectangular parallelepiped shape as its outer shape. The two heads 10 are supported by the frame 3 so as to be distant from each other in the sub-scanning direction. Each head 10 has a multiplicity of ejection openings opening ins the ejection face 10*a* as a lower face of the head 10. In the head 10 are formed channels through which the liquid supplied from a corresponding one of sub-tanks 51 (see FIG. 4) flows to the ejection openings.

The sheet-supply unit 1*c* includes a sheet-supply tray 20 and a sheet-supply roller 21. The sheet-supply tray 20 can be mounted on and removed from the lower housing 1*b* in the sub-scanning direction. The sheet-supply tray 20 has a box-like shape opening upward and can accommodate various sizes of the sheets P. The sheet-supply roller 21 is rotated by the control of the controller 1*p* to supply an uppermost one of the sheets P in the sleet-supply tray 20. The sheet P supplied by the sheet-supply roller 21 is conveyed to the support portion 60 by the conveyor roller pairs 22, 23 in order while being guided by guides 29.

The support portion 60 is disposed so as to face the recording portion 9 in the vertical direction. The support portion 60 includes: two rotors 63 respectively opposed to the heads 10; two platens 61 and two facing members 62 respectively fixed to outer circumferential faces of the rotors 63; and a frame 11 supporting the two rotors 63 rotatably. Each of the rotors 63 has a shaft extending in the main scanning direction and is rotated about the shaft by the control of the controller 1*p*. The frame 11 also supports a lower roller of the conveyor roller pair 24 rotatably.

Each of the platens 61 and the facing members 62 is one size larger than a corresponding one of the ejection faces 10*a* in the main scanning direction and the sub-scanning direction. Each pair of the platens 61 and the facing members 62 are disposed opposite each other in the vertical direction.

A face of each platen 61 is the support face 61*a* for supporting the sheet P while facing the corresponding ejection face 10*a*. A material and a processing for the support face 61*a* are determined so as to reliably hold the sheet P. For example, a silicon layer having a low viscosity is formed on the support face 61*a*, and a multiplicity of ribs are formed on the support face 61*a* in the sub-scanning direction, preventing floating and the like of the sheet P placed on the support face 61*a*. The platen 61 is formed of a resin material.

Figure 4:
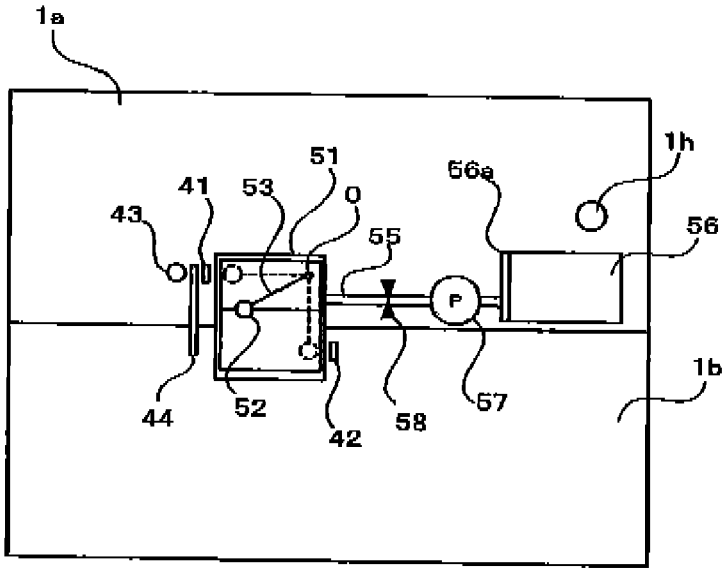
FIG. 4 is a side view generally showing a liquid supply mechanism for supplying liquid to ink jet head shown in FIG. 2.
Figure 5:
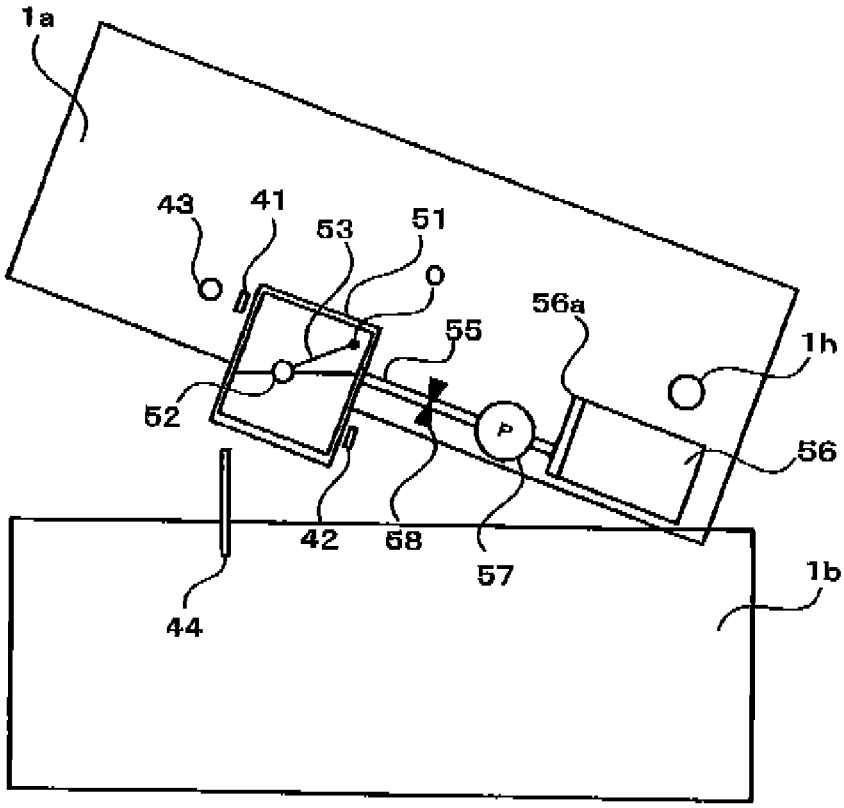
FIG. 5 is a side view generally showing the liquid supply mechanism for supplying the liquid to ink-jet head shown in FIG. 2.

There will be next explained the liquid supply mechanisms for supplying the liquid (the pretreatment liquid and the black ink) to the heads 10 with reference to FIGS. 4 and 5. It is noted that the pretreatment liquid having a property of preventing spread and strike-through of the ink and a property of improving color development and quick drying of the ink, for example. FIGS. 4 and 5 show the liquid supply mechanism for only one of the heads 10. Since the liquid supply mechanisms have the same construction as each other, the following explanation will be given for one liquid supply mechanism for the sake of simplicity unless otherwise required by context. As shown in FIG. 4, the liquid supply mechanism includes the sub-tank 51, a cartridge 56 as one example of a main tank, a liquid-supply channel 55, a pump 57, a valve 58, an upper sensor 41 as one example of a housing position detector, a lower sensor 42, and a magnetic object 43.

The cartridge 56 is for storing the liquid to be supplied to the head 10 and removably installed and held in a cartridge holder 56*a* accommodated in the upper housing 1*a*. The cartridge holder 56*a* has a sensor for sensing whether the cartridge 56 is installed therein. A result of the sensing (sensing result) of the sensor is outputted and transmitted to the controller 1*p*. It is noted that the cartridge holder 56*a* may be accommodated in the lower housing 1*b*.

The sub-tank 51 temporarily stores the liquid supplied from the cartridge 56, before the liquid is supplied to the head 10. The sub-tank 51 is disposed so as to generate negative pressures in the channels of the head 10 in the image recording in order to stabilize meniscuses of the liquid formed in the ejection openings of the head 10. The liquid in the sub-tank 51 is automatically supplied to the head 10 through a tube, not shown.

The cartridge 56 and the sub-tank 51 are connected to each other by the liquid-supply channel 55. The pump 57 and the valve 58 are provided on the liquid-supply channel 55. The pump 57 and the valve 58 are controlled by the controller 1*p*. The valve 58 is opened or closed so as to selectively establish one of a communication state and a non-communication state of the liquid-supply channel 55. When the pump 57 is driven with the valve 58 being opened, the ink in the cartridge 56 is supplied to the sub-tank 51 through the liquid-supply channel 55.

A magnetic float 52 is provided in the sub-tank 51. The magnetic float 52 is fixed to one end of an arm 53. The other end of the arm 53 is fixed at a shaft O fixed to the sub-tank 51 such that the arm 53 can be swung or pivoted about the shaft O. The magnetic float 52 follows a surface or a level of the liquid stored in the sub-tank 51 by its own buoyancy. As the liquid level rises, the magnetic float 52 swings and moves closer to one of inner wall faces of the sub-tank 51 as a left inner face of the sub-tank 51 in FIG. 4. As the liquid level lowers, the magnetic float 52 swings and moves closer to another of the inner wall faces of the sub-tank 51 as a right inner face of the sub-tank 51 in FIG. 4.

The upper sensor 41 supported by the upper housing 1*a* is disposed outside the sub-tank 51 and near an upper end of a left outer face of the sub-tank 51 in FIG. 4, and the lower sensor 42 supported by the upper housing 1*a* is disposed near a lower end of a right outer face of the sub-tank 51 in FIG. 4. Each of the upper sensor 41 and the lower sensor 42 as one example of a liquid amount detector is a sensor operable to sense a magnetic object. When the magnetic object is located near the sensor, the sensor becomes an ON state and outputs an ON signal to the controller 1*p*, and when the magnetic object is located distant from the sensor, the sensor becomes an OFF state and outputs an OFF signal to the controller 1*p*. When an amount of the liquid stored in the sub-tank 51 is an amount corresponding to an upper limit value (i.e., a maximum amount of the liquid), the magnetic float 52 is near the upper sensor 41. When the amount of the liquid stored in the sub-tank 51 is an amount corresponding to a lower limit value (i.e., a minimum amount of the liquid), the magnetic float 52 is near the lower sensor 42. That is, the amount of the liquid stored in the sub-tank 51 can be detected based on sensing (detection) results of the upper sensor 41 and the lower sensor 42. It is noted that, when the amount of the liquid stored in the sub-tank 51 is less than the upper limit value and greater than the lower limit value, each of the upper sensor 41 and the lower sensor 42 outputs the OFF signal.

The magnetic object 43 is fixed to the upper housing 1*a* and disposed near the upper sensor 41 on a left side of the upper sensor 41 in FIG. 4. A magnetic-force canceling plate 44 is fixed to the lower housing 1*b* such that the plate 44 is located between the upper sensor 41 and the magnetic object 43 when the upper housing 1*a* is located at the close position and such that the plate 44 is not located between the upper sensor 41 and the magnetic object 43 when the upper housing 1*a* is located at the distant position. As a result, when the upper housing 1*a* is located at the distant position, the ON state of the upper sensor 41 is forcibly established by the magnetic object 43.

The controller 1*p* includes: a central processing unit (CPU); a read only memory (ROM) configured to rewritably store programs executed by the CPU and data used for the programs; a random access memory (RAM) configured to temporarily store the data in the execution of the programs; and a non-transitory memory (noted that these components are not illustrated). When the upper sensor 41 and the lower sensor 42 respectively become the OFF state and the ON state in the state in which the cartridge 56 is installed or mounted in the cartridge holder 56*a*, the controller 1*p* opens the valve 58 and drives the pump 57 to start a liquid supply operation for supplying the liquid to the sub-tank 51. When the upper sensor 41 becomes the ON state in the liquid supply operation, the controller 1*p* stops the driving of the pump 57 and closes the valve 58 to stop the liquid supply operation. At this stop of the liquid supply operation, when a length of time from the start to the stop of the liquid supply operation is shorter than a specific length of time, the controller 1*p* judges that the upper sensor 41 has become the ON state in response to the movement of the upper housing 1*a* to the distant position, and thus the controller 1*p* changes an interruption flag to its ON state. In a case where the interruption flag is in the ON state, when the upper sensor 41 is in the OFF state in the state in which the cartridge 56 is installed in the cartridge holder 56*a*, the controller 1*p* restarts the liquid supply operation even in the case where the lower sensor 42 is in the OFF state. Further, in a case where the upper sensor 41 has been changed from the ON state to the OFF state, the controller 1*p* restarts the liquid supply operation when a predetermined length of time has passed since the upper sensor 41 has been changed to the OFF state. This predetermined length of time is an enough time to stabilize the liquid surface (i.e., the liquid level) in the sub-tank 51 which has been swayed when the upper housing 1*a* has returned from the distant position to the close position.

Figure 6:
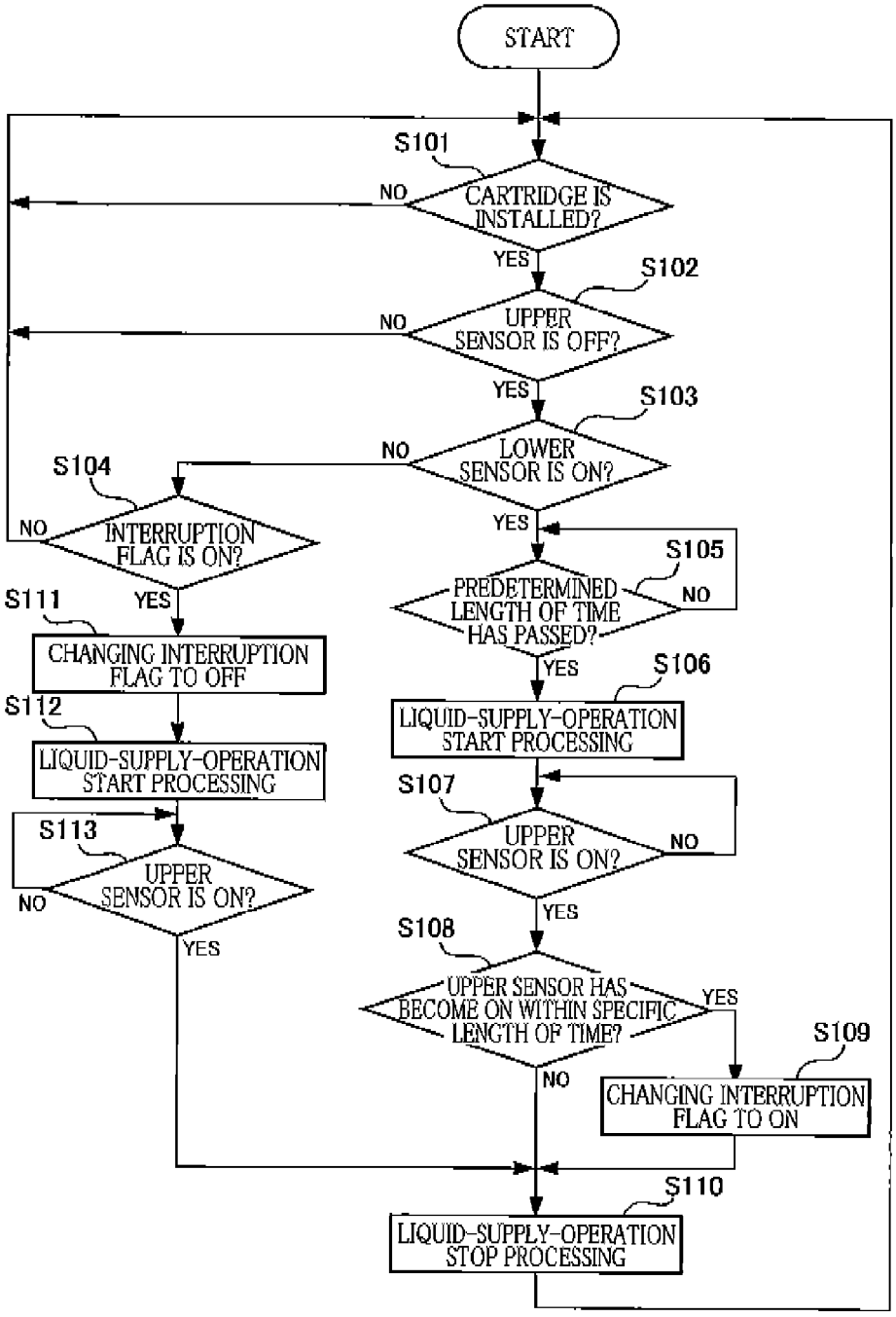
FIG. 6 is a flow chart showing a processing for the liquid supply mechanism shown in FIG. 4.

There will be next explained a control for operating the liquid supply mechanism with reference to FIG. 6. In S101, the controller 1*p* judges whether the cartridge 56 is installed in the cartridge holder 56*a*. When the controller 1*p* judges that the cartridge 56 is not installed in the cartridge holder 56*a* (S101: NO), the controller 1*p* waits until the cartridge 56 is installed in the cartridge holder 56*a*. When the controller 1*p* judges that the cartridge 56 is installed in the cartridge holder 56*a* (S101: YES), the controller 1*p* in S102 judges whether the upper sensor 41 is in the OFF state. When the controller 1*p* judges that the upper sensor 41 is not in the OFF state (S102: NO), this flow returns to S101. When the controller 1*p* judges that the upper sensor 41 is in the OFF state (S102: YES), the controller 1*p* in S103 judges whether the lower sensor 42 is in the ON state.

When the controller 1*p* judges that the lower sensor 42 is in the ON state (S103: NO), the controller 1*p* in S105 waits until the predetermined length of time has passed since the change of the upper sensor 41 from the ON state to the OFF state. When the predetermined length of time has passed (S105: YES), the controller 1*p* in S106 executes a liquid-supply-operation start processing to open the valve 58 and drive the pump 57.

Then in S107, the controller 1*p* waits until the upper sensor 41 becomes the ON state (S107: NO). When the controller 1*p* judges that the upper sensor 41 has become the ON state, in other words, the amount of the liquid in the sub-tank 51 detected by the upper sensor 41 has become equal to or higher than a predetermined value (S107: YES), the controller 1*p* in S108 judges whether the length of time from the start of the liquid supply operation to the change of the upper sensor 41 to the ON state is shorter than the specific length of time, that is, the controller 1*p* judges whether the upper sensor 41 has become the ON state in response to the movement of the upper housing 1*a* to the distant position. When the controller 1*p* judges that the length of time from the start of the liquid supply operation to the change of the upper sensor 41 to the ON state is shorter than the specific length of time (S108: YES), the controller 1*p* in S109 changes the interruption flag to the ON state and then in S110 executes a liquid-supply-operation stop processing. When the length of time from the start of the liquid supply operation to the change of the upper sensor 41 to the ON state is equal to or longer than the specific length of time (S108: NO), the controller 1*p* in S110 executes the liquid-supply-operation stop processing without changing the interruption flag to the ON state. After the liquid-supply-operation stop processing, this flow returns to S101. Further, when the controller 1*p* in S103 judges that the lower sensor 42 is not in the ON state (S103: NO), the controller 1*p* in S104 judges whether the interruption flag is in the ON state. When the controller 1*p* judges that the interruption flag is not in the ON state (S104: NO), this flow returns to S101. On the other hand, when the controller 1*p* judges that the interruption flag is in the ON state (S104: YES), the controller 1*p* in S111 changes the interruption flag to its OFF state and then in S112 executes the liquid-supply-operation start processing. In S113, the controller 1*p* waits until the upper sensor 41 becomes the ON state (S113: NO). When the controller 1*p* judges that the upper sensor 41 has become the ON state (S113: YES), the controller 1*p* in S110 executes the liquid-supply-operation stop processing. After the liquid-supply-operation stop processing, this flow returns to S101.

Here, there will be next explained the processings in the flow chart in FIG. 6 in relation to the position of the upper housing 1*a* and the amount of the liquid in the sub-tank 51. As explained above, when the upper housing 1*a* is at the distant position, the upper sensor 41 is in the ON state, and when the upper housing 1*a* is at the close position, the upper sensor 41 is in the ON or OFF state depending upon the amount of the liquid in the sub-tank 51. Therefore, in the judgment in S102, where the upper sensor 41 is in the OFF state, the upper housing 1*a* is located at the close position without exception. In the judgment in S103, where the lower sensor 42 is in the ON state, the upper housing 1*a* is located at the close position, and the value corresponding to the amount of the liquid in the sub-tank 51 is the lower limit value. In this case, the liquid supply operation is started in S106, and, when the upper housing 1*a* is located at the close position, the liquid supply operation is continued. Then, when the value corresponding to the amount of the liquid in the sub-tank 51 has reached the upper limit value, the controller 1*p* in S107 judges that the upper sensor 41 has become the ON state. Here, the specific length of time used in the judgment in S108 is a length of time which is required from a point in time when the liquid supply mechanism starts to supply the liquid into the sub-tank 51 in the case where the value corresponding to the amount of the liquid in the sub-tank 51 is the lower limit value in the state in which the upper housing 1*a* is located at the close position, to a point in time when the amount of the liquid in the sub-tank 51 reaches the upper limit value. That is, where the length of time from the start of the liquid supply to the establishment of the ON state of the upper sensor 41 is shorter than the specific length of time, the upper sensor 41 does not become the ON state only by the raising of the liquid level in the sub-tank 51 by the liquid supply. Thus, the upper sensor 41 becomes the ON state because the upper housing 1*a* is moved from the close position to the distant position. Accordingly, in this case (S108: YES), the liquid supply can be restarted also in the case where the interruption flag is turned to the ON state in S109, then the liquid supply to the sub-tank 51 is stopped in S110, and then the controller 1*p* judges that the upper housing 1*a* is located at the close position (S102: YES) and that the value corresponding to the amount of the liquid in the sub-tank 51 is not the lower limit value (S103: NO).

In a printer having a construction as described above, when the upper housing is located at the distant position, the sub-tank is inclined. Thus, the liquid level in the sub-tank cannot be sensed or detected accurately, leading to an unnecessary or unintended liquid supply operation or processing. However, in the printer 1 as the present embodiment described above, when the upper housing 1*a* is located at the distant position, the liquid supply operation is not performed. This makes it possible to avoid the unintended liquid supply processing owing to the erroneous sensing of the liquid level.

Further, the controller 1*p* does not perform the liquid supply operation until the predetermined length of time has passed since the upper housing 1*a* had been moved from the distant position to the close position. That is, the liquid supply operation is not performed while the liquid surface in the sub-tank 51 is being swayed just after the upper housing 1*a* has been moved to the close position. This makes it possible to avoid the unintended liquid supply control caused by the erroneous sensing owing to the swaying of the liquid surface.

Further, since the upper sensor 41 is forcibly changed to the ON state when the upper housing 1*a* is located at the distant position, the controller 1*p* can easily control the liquid supply mechanism.

Further, since the liquid supply operation is not started when the cartridge 56 is not installed in the cartridge holder 56*a*, it is possible to prevent the unnecessary liquid supply operation.

Further, when the liquid supply operation is interrupted in response to the movement of the upper housing 1*a* to the distant position, the controller 1*p* restarts the liquid supply operation when the upper housing 1*a* is moved to the close position after the interruption. Thus, the liquid supply operation can be finished reliably.

Further, the controller 1*p* stops the liquid supply operation after the upper sensor 41 is changed to the ON state. Thus, it is possible to reliably prevent the liquid from leaking from the sub-tank 51.

Further, the controller 1*p* stops the driving of the pump 57 and closes the valve 58 to stop the liquid supply operation. Thus, the liquid supply operation can be inhibited with a simple construction.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, in the above-described embodiment, the liquid supply operation is not performed until the predetermined length of time has passed since the upper housing 1*a* had been moved from the distant position to the close position. However, the liquid supply operation may be performed or started when the upper housing 1*a* is moved from the distant position to the close position.

Further, in the above-described embodiment, when the upper housing 1*a* is located at the distant position, the upper sensor 41 is forcibly turned to the ON state. However, when the upper housing 1*a* is located at the distant position, the upper sensor 41 may not be forcibly turned to the ON state. In this case, an additional sensor is preferably provided for sensing that the upper housing 1*a* is located at the distant position. Where the printer 1 is thus constructed, the movement of the upper housing 1*a* from the close position to the distant position can be sensed immediately, making it possible to speedily interrupt the above-described liquid supply operation.

Further, in the above-described embodiment, the liquid supply operation is not started when the cartridge 56 is not installed in the cartridge holder 56, but the liquid supply operation may be started without judging whether the cartridge 56 is installed in the cartridge holder 56*a*.

Further, in the above-described embodiment, where the liquid supply operation is interrupted in response to the movement of the upper housing 1*a* to the distant position, the controller 1*p* restarts the liquid supply operation when the upper housing 1*a* is moved to the close position after the interruption, but the liquid supply operation may not be restarted in such a case.

Further, in the above-described embodiment, the liquid supply operation is stopped when the upper sensor 41 becomes the ON state after the start of the liquid supply operation, but the liquid supply operation may be stopped without considering the sensing result of the upper sensor 41. For example, the liquid supply operation may be stopped when a length of time of the driving of the pump 57 becomes equal to or longer than a certain length of time.

Further, in the above-described embodiment, the amount of the liquid in the sub-tank 51 is detected by detecting the height position of the liquid surface by the upper sensor 41, the lower sensor 42, and the magnetic float 52. However, the detection of the amount of the liquid in the sub-tank 51 is not limited to this manner. For example, the amount of the liquid in the sub-tank 51 may be detected by a change in the sub-tank 51. Alternatively, the amount of the liquid in the sub-tank 51 may be determined by calculating an amount of the liquid supplied to the sub-tank 51 and an amount of the liquid ejected from the head 10. In this configuration, the ink-jet printer 1 can omit the lower sensor 42 that is for detecting the amount of the liquid in the sub-tank 51.

Further, in the above-described embodiment, the supply of the liquid to the sub-tank 51 is started when the upper sensor 41 and the lower sensor 42 become the OFF state and the ON state, respectively. However, the supply of the liquid to the sub-tank 51 is not limited to this manner. For example, the printer 1 may be configured such that the amount of the liquid ejected from the head 10 is calculated, and the supply of the liquid to the sub-tank 51 is started when the amount of the liquid ejected from the head 10 exceeds a predetermined amount. That is, where the printer 1 is thus configured, the supply of the liquid can be started without judging whether the lower sensor 42 has become the ON state. Thus, the ink-jet printer 1 can omit the lower sensor 42.

Further, in the above-described embodiment, when the upper housing 1*a* is moved to the distant position after the start of the supply of the liquid to the sub-tank 51, the upper sensor 41 outputs the ON signal, and the supply of the liquid to the sub-tank 51 is stopped. However, the manner of the stop of the supply of the liquid to the sub-tank 51 is not limited to this manner. For example, in a case where a jam has occurred in the printing of the sheet P in the ink-jet printer 1, there is a high possibility that the upper housing 1*a* will be moved to the distant position to remove the jammed sheet P. In this case, the controller 1*p* may stop the supply of the liquid to the sub-tank 51 on condition that the jam has occurred. Also in this configuration, the supply of the liquid to the sub-tank 51 can be stopped when the upper housing 1*a* is moved to the distant position, making it possible to prevent the ink to be excessively supplied to the sub-tank 51.

Further, in the above-described embodiment, the controller 1*p* stops the driving of the pump 57 and closes the valve 58 to stop the liquid supply operation, but the liquid supply operation may be stopped only by stopping the pump 57. Further, in a case where the pump is not used to supply the ink from the cartridge 56 to the sub-tank 51, for example, where a hydraulic head pressure is used, the liquid supply operation may be stopped only by closing the valve.

Further, in the above-described embodiment, the controller 1*p* is configured by the single CPU but may be configured by a plurality of CPUs, an application-specific integrated circuit (ASIC), or a combination of the CPU(s) and the ASIC.

The present invention is applicable to both of the line printer and a serial printer. Further, the present invention is applicable not only to the printer but also to a facsimile machine and a copying machine, for example. Furthermore, the present invention is applicable to a recording apparatus configured to perform the recording by ejecting liquid other than the ink.

Further, while the sheet P is supported on the platen 61 in the above-described embodiment, the printer 1 may include a belt conveyor mechanism which conveys the sheet P. In this configuration, the sheet P is supported on a belt of the belt conveyor mechanism instead of the platen 61.

What is claimed is:

1. A liquid ejection apparatus, comprising:

a platen configured to support a recording medium;

a recording head having at least one ejection opening through which liquid is ejected, the recording head being configured to eject the liquid through the at least one ejection opening to record an image on the recording medium supported by the platen;

a main tank configured to store the liquid;

a sub-tank configured to temporarily store the liquid stored in the main tank, before the liquid is supplied to the recording head;

a liquid amount detector configured to detect an amount of the liquid in the sub-tank;

a supplier configured to supply the liquid stored in the main tank, to the sub-tank;

a first housing configured to hold at least the platen;

a second housing configured to hold at least the sub-tank and the recording head and connected to the first housing such that the second housing is pivotable with respect to the first housing so as to be selectively positioned at one of (i) a close position at which the recording head is close to the first housing and (ii) a distant position at which the recording head is farther from the first housing than the recording head located at the close position;

a housing position detector configured to detect whether the second housing is located at the close position or the distant position; and a controller configured to, when the housing position detector detects that the second housing is located at the close position, control the supplier to supply the liquid to the sub-tank based on the amount of the liquid which has been detected by the liquid amount detector.

2. The liquid ejection apparatus according to claim 1, wherein the controller is configured to, when the housing position detector detects that the second housing is located at the distant position, inhibit the supplier from supplying the liquid to the sub-tank based on the amount of the liquid which has been detected by the liquid amount detector.

3. The liquid ejection apparatus according to claim 1, wherein the controller is configured to control the supplier not to supply the liquid to the sub-tank until a predetermined length of time has passed since the pivotal movement of the second housing from the distant position to the close position.

4. The liquid ejection apparatus according to claim 1, wherein, when the second housing is located at the distant position, the liquid amount detector outputs at least one of corrected amounts each of which does not cause the supplier to supply the liquid to the sub-tank.

5. The liquid ejection apparatus according to claim 1, wherein the main tank is mountable in and removable from a holder provided in one of the second housing and the first housing, and wherein, when the main tank is not mounted in the holder, the controller controls the supplier not to supply the liquid to the sub-tank.

6. The liquid ejection apparatus according to claim 1, wherein, after the supply of the liquid to the sub-tank by the supplier has been interrupted in response to the pivotal movement of the second housing to the distant position, the controller restarts the supply of the liquid when the second housing is pivoted to the close position after the interruption.

7. The liquid ejection apparatus according to claim 1, when the amount of the liquid which has been detected by the liquid amount detector becomes equal to or greater than an amount corresponding to a predetermined value, the controller stops the supplier from supplying the liquid to the sub-tank.

8. The liquid ejection apparatus according to claim 1, wherein the supplier includes a pump configured to supply the liquid stored in the main tank to the sub-tank, and wherein the controller is configured to stop the pump to stop the supplier from supplying the liquid to the sub-tank.

9. The liquid ejection apparatus according to claim 1, wherein the supplier is disposed on a communication passage by which the main tank and the sub-tank are communicated with each other, wherein the supplier includes a valve configured to selectively establish one of a communication state and a non-communication state of the communication passage, and wherein the controller is configured to control the valve to establish the non-communication state of the communication passage to stop the supplier from supplying the liquid to the sub-tank.

10. A liquid ejection apparatus, comprising:

a platen configured to support a recording medium;

a recording head having at least one ejection opening through which liquid is ejected, the recording head being configured to eject the liquid through the at least one ejection opening to record an image on the recording medium supported by the platen;

a main tank configured to store the liquid;

a sub-tank configured to temporarily store the liquid stored in the main tank, before the liquid is supplied to the recording head;

a supplier configured to supply the liquid stored in the main tank, to the sub-tank;

a first housing configured to hold at least the platen;

a second housing configured to hold at least the sub-tank and the recording head and connected to the first housing such that the second housing is pivotable with respect to the first housing so as to be selectively positioned at one of (i) a close position at which the recording head is close to the first housing and (ii) a distant position at which the recording head is farther from the first housing than the recording head located at the close position; and a controller configured to:

when it is detected that the second housing is located at the close position, allow the supplier to supply the liquid to the sub-tank; and when it is detected that the second housing is located at the distant position, inhibit the supplier from supplying the liquid to the sub-tank.

11. A method for supplying liquid to a sub-tank of a liquid ejection apparatus, the liquid ejection apparatus comprising: a platen configured to support a recording medium; a recording head having at least one ejection opening through which liquid is ejected, the recording head being configured to eject the liquid through the at least one ejection opening to record an image on the recording medium supported by the platen; a main tank configured to store the liquid; a sub-tank configured to temporarily store the liquid stored in the main tank, before the liquid is supplied to the recording head; a liquid amount detector configured to detect an amount of the liquid in the sub-tank; a supplier configured to supply the liquid stored in the main tank, to the sub-tank; a first housing configured to hold at least the platen; a second housing configured to hold at least the sub-tank and the recording head and connected to the first housing such that the second housing is pivotable with respect to the first housing so as to be selectively positioned at one of (i) a close position at which the recording head is close to the first housing and (ii) a distant position at which the recording head is farther from the first housing than the recording head located at the close position; and a housing position detector configured to detect whether the second housing is located at the close position or the distant position, the method comprising, when the housing position detector detects that the second housing is located at the close position, controlling the supplier to supply the liquid to the sub-tank based on the amount of the liquid which has been detected by the liquid amount detector.

12. A liquid ejection apparatus, comprising:

a support portion configured to support a recording medium;

a recording head having at least one ejection opening through which liquid is ejected, the recording head being configured to eject the liquid through the at least one ejection opening to record an image on the recording medium supported by the support portion;

a main tank configured to store the liquid;

a sub-tank configured to temporarily store the liquid stored in the main tank, before the liquid is supplied to the recording head;

a liquid amount detector configured to detect an amount of the liquid in the sub-tank;

a supplier configured to supply the liquid stored in, the main tank, to the sub-tank;

a first housing configured to hold at least the support portion;

a second housing configured to hold at least the sub-tank and the recording head and connected to the first housing such that the second housing is pivotable with respect to the first housing so as to be selectively positioned at one of (i) a close position at which the recording head is close to the first housing and (ii) a distant position at which the recording head is farther from the first housing than the recording head located at the close position;

a housing position detector configured to detect whether the second housing is located at the close position or the distant position; and a controller configured to, when the housing position detector detects that the second housing is located at the close position, control the supplier to supply the liquid to the sub-tank based on the amount of the liquid which has been detected by the liquid amount detector.

* * * * *